US010321252B2

(12) United States Patent
Rosset et al.

(10) Patent No.: US 10,321,252 B2
(45) Date of Patent: Jun. 11, 2019

(54) TRANSAURAL SYNTHESIS METHOD FOR SOUND SPATIALIZATION

(71) Applicant: A3D Technologies LLC, Los Angeles, CA (US)

(72) Inventors: Franck Vincent Rosset, Brussels (BE); Jean-Luc Haurais, Paris (FR)

(73) Assignee: AXD Technologies, LLC, Los Angeles, CA (US)

( * ) Notice: Subject to any disclaimer, the term of this patent is extended or adjusted under 35 U.S.C. 154(b) by 0 days.

(21) Appl. No.: 15/373,617

(22) Filed: Dec. 9, 2016

(65) Prior Publication Data

US 2017/0215018 A1 Jul. 27, 2017

Related U.S. Application Data

(63) Continuation-in-part of application No. 14/377,935, filed as application No. PCT/FR2013/050278 on Feb. 11, 2013, now abandoned.

(30) Foreign Application Priority Data

Feb. 13, 2012 (FR) ..... 12 51328

(51) Int. Cl.
*H04S 3/00* (2006.01)
*H04S 5/00* (2006.01)

(52) U.S. Cl.
CPC ..... *H04S 3/002* (2013.01); *H04S 5/005* (2013.01); *H04S 2400/03* (2013.01); *H04S 2400/11* (2013.01)

(58) Field of Classification Search
CPC ..... H04S 7/304; H04S 7/301; H04S 3/002; H04S 2400/03; H04S 2400/11; H04S 3/004; H04S 2420/01; G10L 19/008
See application file for complete search history.

(56) References Cited

U.S. PATENT DOCUMENTS 5,438,623 A 8/1995 Begault
5,521,981 A 5/1996 Gehring
(Continued)

FOREIGN PATENT DOCUMENTS

CN 101406074 4/2009
EP 1372356 A1 12/2003
(Continued)

OTHER PUBLICATIONS

Masiero, Individualized Binaural Technology, 2012.*
(Continued)

*Primary Examiner* — Davetta W Goins
*Assistant Examiner* — Kuassi A Ganmavo
(74) *Attorney, Agent, or Firm* — Knobbe, Martens, Olson & Bear, LLP

(57) ABSTRACT

A method of producing a spatialized stereo audio file from an original stereo audio file comprises creating a data base of impulse responses realized in at least one physical space divided into left, right, front, back, up and down sides relative to a sound acquisition position, with at least one pair of acquisition microphones placed at the sound acquisition position, with at least two pairs of source loudspeakers placed at sound source positions; the sound acquisition position is situated at the left-right median plane of the physical space, the sound source positions are distributed symmetrically by pairs relative to the sound acquisition position, the data base of impulse responses comprising at least one left/right impulse response pair, the left and right impulse responses being obtained by a deconvolution of the direct acquired signal from all the source loudspeakers distributed at the respective left and right side of the physical space.

11 Claims, 6 Drawing Sheets

(56) References Cited

U.S. PATENT DOCUMENTS

| | | | | |
|---|---|---|---|---|
| 5,666,425 | A | 9/1997 | Sibbald et al. | |
| 5,729,612 | A * | 3/1998 | Abel | H04R 29/001 381/1 |
| 5,742,689 | A | 4/1998 | Tucker et al. | |
| 6,424,719 | B1 * | 7/2002 | Elko | H04S 1/00 381/1 |
| 6,741,706 | B1 * | 5/2004 | McGrath | H04S 3/004 381/22 |
| 8,325,931 | B2 * | 12/2012 | Howard | H04R 29/003 324/525 |
| 2002/0133327 | A1 * | 9/2002 | McGrath | H04R 5/04 703/21 |
| 2003/0035553 | A1 | 2/2003 | Baumgarte et al. | |
| 2003/0123676 | A1 * | 7/2003 | Schobben | H04S 7/00 381/74 |
| 2003/0202667 | A1 | 10/2003 | Sekine | |
| 2005/0135643 | A1 | 6/2005 | Lee et al. | |
| 2005/0254660 | A1 | 11/2005 | Sakurai et al. | |
| 2006/0050909 | A1 * | 3/2006 | Kim | H04R 3/02 381/309 |
| 2007/0011025 | A1 | 1/2007 | Cracchiolo et al. | |
| 2007/0135952 | A1 | 6/2007 | Chubarev | |
| 2007/0253559 | A1 * | 11/2007 | Vernon | H04R 29/00 381/56 |
| 2008/0025534 | A1 | 1/2008 | Kuhn et al. | |
| 2008/0212788 | A1 | 9/2008 | Bech et al. | |
| 2009/0103738 | A1 | 4/2009 | Faure et al. | |
| 2009/0123007 | A1 * | 5/2009 | Katayama | H04S 7/302 381/300 |
| 2009/0222272 | A1 | 9/2009 | Seefeldt et al. | |
| 2010/0124347 | A1 * | 5/2010 | Greiner | H04R 25/552 381/314 |
| 2011/0311065 | A1 | 12/2011 | Horbach et al. | |
| 2012/0109645 | A1 * | 5/2012 | Hallam | G10L 21/028 704/207 |
| 2015/0110310 | A1 * | 4/2015 | Minnaar | H04R 5/00 381/307 |
| 2015/0117659 | A1 * | 4/2015 | Kirsch | A61F 11/14 381/72 |

FOREIGN PATENT DOCUMENTS

| | | | |
|---|---|---|---|
| EP | 1545154 | A2 | 6/2005 |
| JP | 2003316371 | | 11/2003 |
| JP | 2005184837 | | 7/2005 |
| JP | 2005252332 | | 9/2005 |
| JP | 2006339694 | | 12/2006 |
| JP | 2008301427 | | 12/2008 |
| JP | 2008546270 | | 12/2008 |
| JP | 2009503615 | | 1/2009 |
| MX | 2008011994 | A | 11/2008 |

OTHER PUBLICATIONS

Apple, Impulse response utility user manual, 2009.*

ITU-R, Multichannel Sound technology in home and broadcasting applications, 2012.*

Farina et al, Automated Measurement System for car audio applications, AES, 1998.*

Lee et al, A spatial Audio System using multiple microphones on a rigid sphere,2004.*

Jan Plogsties et al.; MPEG Surround Binaural Rendering-Surround Sound for Mobile Devices ( Binaurale Wiedergabe mit MPEG Surround—Surround sound for mobile Gerate); Tonmeistertagung—VDT International Convention, Nov. 2006, XP007902572; No. 24, pp. 1-19.

Breebart et al, Multi-Channel goes mobile MPRG Surround Binaural Rendering, AES29, 2006.

Jeub M., et al.: "A binaural room impulse response database for the evaluation of dereverberation algorithms", Digitalsignal Processing, 2009 16th Internationalconference on, IEEE, Piscataway, NJ, USA, Jul. 5, 2009 Jul. 5, 2009), pp. 1-5, XP031510342, ISBN: 978-1-4244-3297-4.

* cited by examiner

TRANSAURAL SYNTHESIS METHOD FOR SOUND SPATIALIZATION

CROSS-REFERENCE TO RELATED APPLICATIONS

This application is a Continuation-In-Part of U.S. patent application Ser. No. 14/377,935, filed Aug. 11, 2014 which claims priority from PCT Patent Application Serial No. PCT/FR2013/050278, filed Feb. 11, 2013, and which are also incorporated herein by reference.

BACKGROUND

The present invention relates to the field of sound spatialization, also called spatialized rendering, of audio signals, more particularly integrating a room effect, especially in the field of transaural techniques.

The word "binaural" relates to the reproduction on a pair of headphones, or a pair of earpieces, or a pair of loudspeakers, of a sound signal, but still with spatialization effects. The invention is not however restricted to the above-mentioned technique and is notably applicable to techniques derived from the "binaural" techniques such as the "transaural" (registered tradename) reproduction techniques, i.e. on remote loudspeakers, for instance installed in a concert hall or in movie theatre with a multipoint sound system.

A specific application of the invention consists, for example, in enriching the audio contents broadcast by a pair of loudspeakers in order to immerse a listener in a spatialized sound scene, and more particularly including a room effect or an outdoor effect.

PRIOR ART

For the implementation of the "binaural" techniques on headphones or loudspeakers, a transfer function or filter is defined in the state of the art, for a sound signal between the position of a sound source in space and the two ears of a listener. The aforementioned acoustic transfer function of the head is denoted HRTF, for "Head Related Transfer Function", in its frequency form and HRIR for "Head Related Impulse Response" in its temporal form. For one direction in space, two HRTFs are ultimately obtained: one for the right ear and one for the left ear.

More particularly, the binaural technique consists in applying such acoustic transfer functions for the head to monophonic audio signals, in order to obtain a stereophonic signal which, when listened to on a pair of headphones, provides the listener with the sensation that the sound sources originate from a particular direction in space. The signal for the right ear is obtained by filtering the monophonic signal by the HRTF of the right ear and the signal for the left ear is obtained by filtering the same monophonic signal by the HRTF of the left ear.

In the space rendering, when the fact that the listener perceives the sound sources at variable distances away from his/her head, which is a phenomenon known by the term "externalization", is taken into account, in a manner that is independent from the direction or origin of the sound sources, it frequently happens, in a binaural 3D rendering, that the sources are perceived to be inside the head of the listener. The source thus perceived is referred to as "non-externalized".

Various studies have shown that the addition of a room effect in the binaural 3D rendering methods allows the externalization of the sound sources to be considerably enhanced.

The patent application US 2007/011025A is known in the state of the art, which discloses a method for sound spatialization comprising a step of determining an acoustic matrix for a real set of sound sources at a real location and a step of calculating an acoustic matrix for the transmission of an acoustic signal of a set of apparent sound sources, at locations different from the real locations of the listener. The method further includes a step of resolution of a transfer function matrix to provide the listener with an audio signal creating an audio image of a sound originating from the apparent source.

The solutions of the prior art are set and do not enable to choose a 3D soundscape among several possible soundscapes. They are generally based on a transformation matrix calculated from a virtual head.

The solutions of the prior art generally do not enable one to have the sensation that the sound environment is externalized.

The physical rooms and the physical enclosures make it possible to calculate the filters which will be used to generate the multichannels.

Another method to spatialize the stereo signal. As the state of the art, the U.S. Pat. No. 5,742,689 describes a technique to process the multi-channel output that is typically produced by home entertainment systems, such that when the multi-channel output is presented over headphones, the listener would experience multiple loudspeakers and a sensation of open-ear listening.

This is realized through the application of filtering using HRTF for each channel (1-5 in the FIG. 4) of the multichannel audio signal as illustrated in the U.S. Pat. No. 5,742,689. The most closely matched sensation is realized by the selection of HRTF from a large database (63-65 in FIG. 4). In order to create spatialized listening experience, several companies have developed several kinds of multichannel audio formats, Sony, Dolby etc. However, all of them requires a large calculation capacity to treat each channel, which takes calculation time and resource, thus not suitable for the small capacity processors, like those used in the smart phone or tablet.

SUMMARY

In accordance with the present disclosure there is provided a method for producing a digital spatialized stereo audio file from an original multichannel audio file, characterized in that it comprises:

- a step of performing a processing on each of the channels for cross-talk cancellation;
- a step of merging the channels in order to produce a stereo signal;
- a step of dynamic filtering and specific equalization for increasing the sound dynamics.

In an exemplary embodiment the method for producing a digital spatialized stereo audio file comprises the step of cross-talk cancellation consists in adding to the signal of each of the channels a signal corresponding to the out-of-phase and weighted signal of the other channels.

In an exemplary embodiment the method for producing a digital spatialized stereo audio file wherein the original signal is a native 5.n multichannel signal.

In an exemplary embodiment the method for producing a digital spatialized stereo audio file wherein the original signal is a native 5.n multichannel signal calculated from a stereo signal.

The present invention provides a method to treat directly a stereo signal of mono left/right input signal. Each mono left/right input of the stereo signal is processed with an impulse response created respectively for the left and the right channel.

The advantage of the present invention is that the deletion of the multi-channel treatment economises largely the calculation time and calculation capacity.

The invention concerns a method of producing a spatialized stereo audio file from an original stereo audio file, comprising a creation of a data base of impulse responses the creation of said impulse response is realised in at least one physical space, said physical space is divided into left and right sides, front and back sides, up and down sides relative to a sound acquisition position, with at least one pair of acquisition microphones placed at the sound acquisition position, with at least two pairs of source loudspeakers placed at a plurality of sound source positions.

The invention is characterized in that: the sound acquisition position is situated at the left-right median plane of said physical space, said sound source positions are distributed symmetrically by pairs relative to said sound acquisition position, said data base of impulse responses comprising at least one pair of left/right impulse responses, the left impulse response being obtained by a deconvolution of the direct acquired sound signal from all the source loudspeakers distributed at the left side of the physical space, called left source loudspeakers, the right impulse response being obtained by a deconvolution of the direct acquired sound signal from all the source loudspeakers distributed at the right side of the physical space, called right source loudspeakers.

In the embodiment, the invention contains at least one of the following characteristics. A central loudspeaker is positioned at the sound source position situated at the left-right median plane and in front of the sound acquisition position, wherein the left impulse response is obtained by a deconvolution of the direct acquired signal from the left source loudspeakers and the central loudspeaker, wherein the right impulse response is obtained by a deconvolution of the direct acquired signal from the right source loudspeakers and the central loudspeaker.

In one embodiment, the sound source positions are distributed around a circle of 360° around said sound acquisition position, except an arc region of 30° behind the sound acquisition position (music mode), wherein said sound source positions are distributed at the same height.

In another embodiment, the sound source positions are distributed in a sphere of 4pi around said sound acquisition position, except a region corresponding to 30° solid angle behind the sound acquisition position (cinema mode), wherein each pair of sound source positions distributed symmetrically to the left-right median plan are at the same height, but not all pairs of sound source positions are at the same height, wherein from front side to the back side, the height of each pair of sound source positions increases constantly.

The spatialized stereo audio file is realized by a treatment of convoluting the original stereo audio file with the said pair of left and right impulse response. In one embodiment, the treatment is realized remotely (on a server). In another embodiment, the treatment is realized locally (on a local processor).

Utilization of the method of producing a spatialized stereo audio file, wherein during the broadcast of the spatialized stereo audio file, a reproduced virtual sound source position is movable by tuning the power balance between the left and right broadcast channels.

BRIEF DESCRIPTION OF THE DRAWINGS

The present invention will be better understood by reading the following description, and referring to the appended drawings, wherein.

DETAILED DESCRIPTION

The method according to the invention comprises a first processing 1 consisting in producing a data base of pulse signals from the acquisition of acoustic signals in a plurality of physical spaces, by recording the signals produced by acoustic loudspeakers in response to a reference multi-frequency signal.

Then, for each audio sequence to be spatialized, the method consists in applying a succession of processing operations:

- when the signal to be spatialized is a stereo signal, the method comprises a preliminary step 2 of generating an N.i signal from the stereo signal,
- a step 3 of transforming the signal of each one of the N.i channels from one of the pulse response files selected in the abovementioned data base,
- a step 4 of recombining the signals of the thus transformed N.i channels to produce a spatialized stereo signal.

This stereo signal can then be broadcast by a couple of standard acoustic loudspeakers, in order to reproduce a spatialized soundscape corresponding to the space used for producing the pulse response signals or a combination of such spaces.

Initial Step of Production of the Pulse Response Data Base

Figure 1:
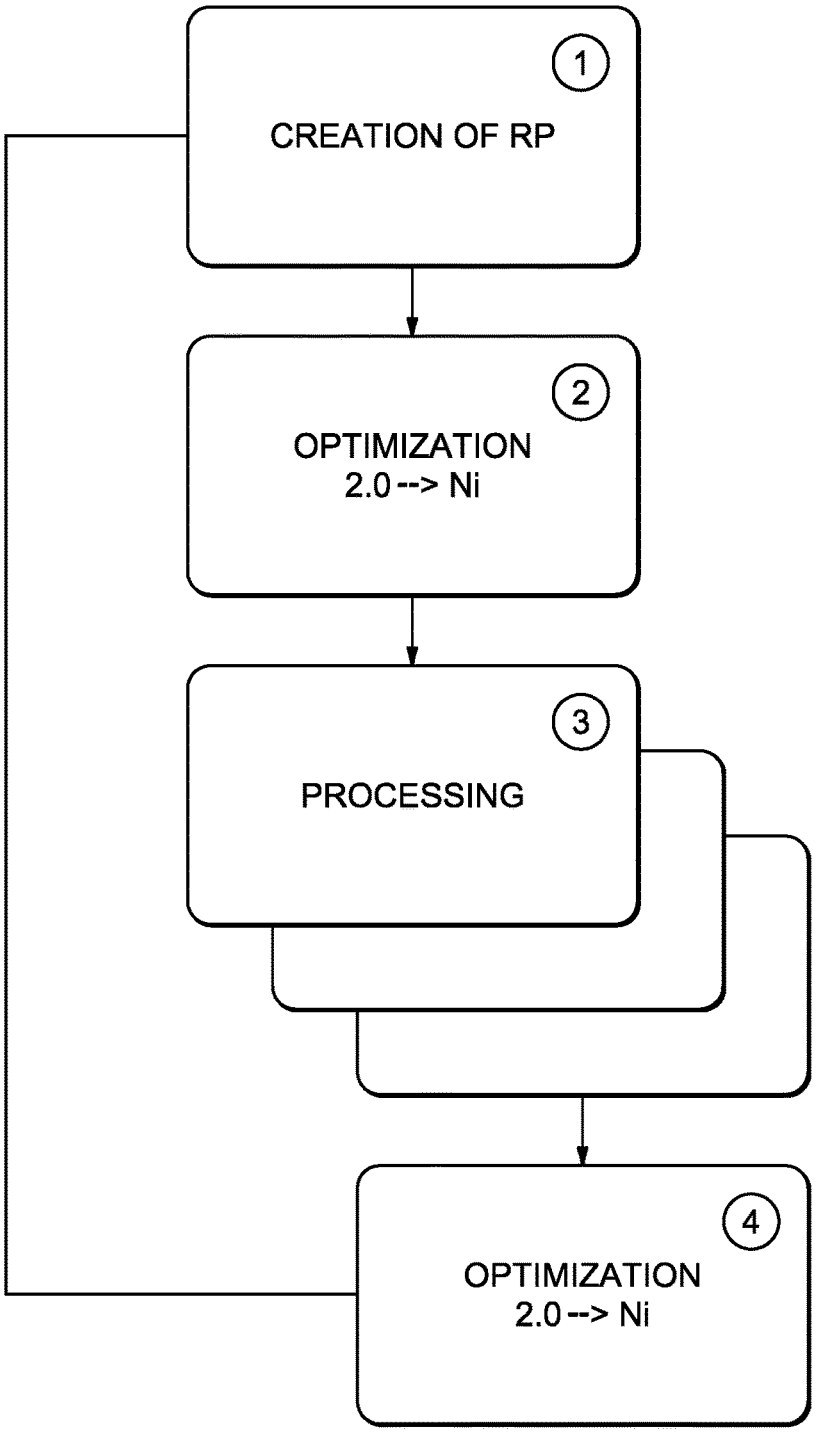
FIG. 1 shows a general block diagram of the installation intended for the step of producing the data base of pulse signals.
Figure 2:
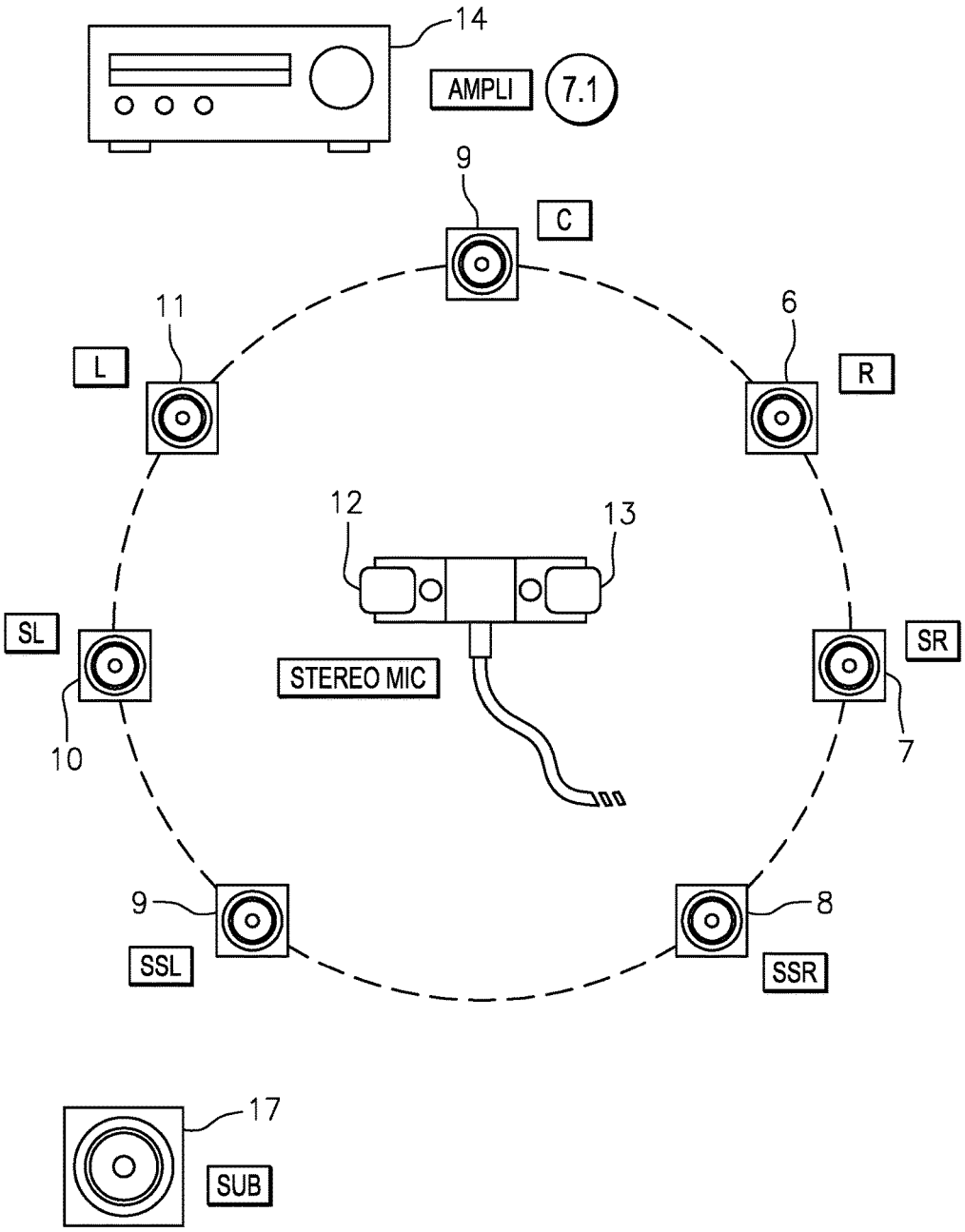
FIG. 2 shows a schematic view of the installation for the acquisition of the pulse signals.

This step is repeated a plurality of times. It is illustrated in FIG. 2.

It consists, for each series of pulse responses, in positioning, in a physical space such as a concert hall, an open or a closed place, or given premises, a series of known acoustic loudspeakers 5 to 11; 17, associated with an amplifier 14, preferably of a known quality, as well as a couple of microphones 12, 13, the position of which relative to the series of loudspeakers 5 to 11; 17 is set for the series being acquired.

Then an original multi-frequency signal is successively applied to each one of the loudspeakers 5 to 11 using the amplifier 14. Such original signal is for example a sequence having a duration ranging from 10 to 90 seconds, with a frequency variation within the sound spectrum. Such signal is for instance a linear variation between 20 Hz and 20 Khz, or still any signal covering the whole spectrum of the loudspeaker.

The sound signal produced by the active loudspeaker is picked up by the couple of microphones 12, 13 and produces a recorded stereo signal. From this signal, a 96 Khz sampling is knowingly executed as well as a deconvolution by fast Fourier transform between the original signal and the recorded signal, to produce a pulse response for the considered loudspeaker in the considered physical space.

This step is reproduced for each one of the loudspeakers 5 to 11 in the series, and then for various physical spaces wherein a series of loudspeakers, whether identical or different, are positioned together with an identical or different amplifier and identical microphones.

This first step leads to the production of a data base of stereo pulse responses.

Step of Preparing a Spatialized Signal

This step makes it possible to produce a spatialized stereo audio signal from an N.i multichannel signal corresponding to a traditional digital recording.

Such step consists in selecting N+1 pulse responses from the data base created during the initial step.

The selection will consist in associating to each one of the N+1 signals one of the pulse responses of said data base, by taking care that the position of the acquisition in space of the pulse response corresponds to the position in space of the channel it is associated with.

For each "mono signal/stereo pulse response", a convolution processing is applied in order to calculate a couple of stereo spatialized signals $S_{sG}$ and $S_{sD}$.

Then N+1 couples of j spatialized signals $S^j_{sG}$ and $S^j_{sD}$, with j ranging from 1 to N+1, are thus produced.

For example, if the initial recording was of the 5.1 type, 6 couples of spatialized signals will be produced.

Optionally, the channels are equalized to improve the dynamics of the j signals.

Production of a Spatialized Stereo Signal

The final step consists in recombining the j signals to produce a couple of spatialized right and left signals.

Therefor, the j signals $S^j_{sG}$ corresponding to the space positioned on the left are added to produce the left channel of the spatialized stereo signal. The same is done for the signals $S^j_{sD}$ corresponding to the space positioned on the right to produce the right channel of the spatialized stereo signal.

Optionally, the channels are equalized to improve the dynamics of the j signals.

Case of a Stereo Original Signal; Increase in the Number of Channels and Creation of Intermediary Channels When the signal to be spatialized is not of the N.i type but simply a stereo signal, an intermediate step is executed, which consists in producing an N.i signal by phase extraction processing between the left track and the right track, to produce new different signals.

Such phase extraction consists in producing a signal corresponding to a reproduced central channel, through a processing consisting in adding the left channel signal and an out-of-phase right channel signal, for instance in anti-phase.

To create the other "reproduced" channels, the left and right tracks are phase-shifted, with different phase angles, and the couples of out-of-phase signals are added, with empirically determined weighting, in order to render a spatialized soundscape.

Besides, frequency filters are applied on the right and left signals, upon the creation of "reproduced" channels in order to increase the dynamics of the signal and keep a high-fidelity quality of the sound.

Reproduction of the Signal

Figure 3:
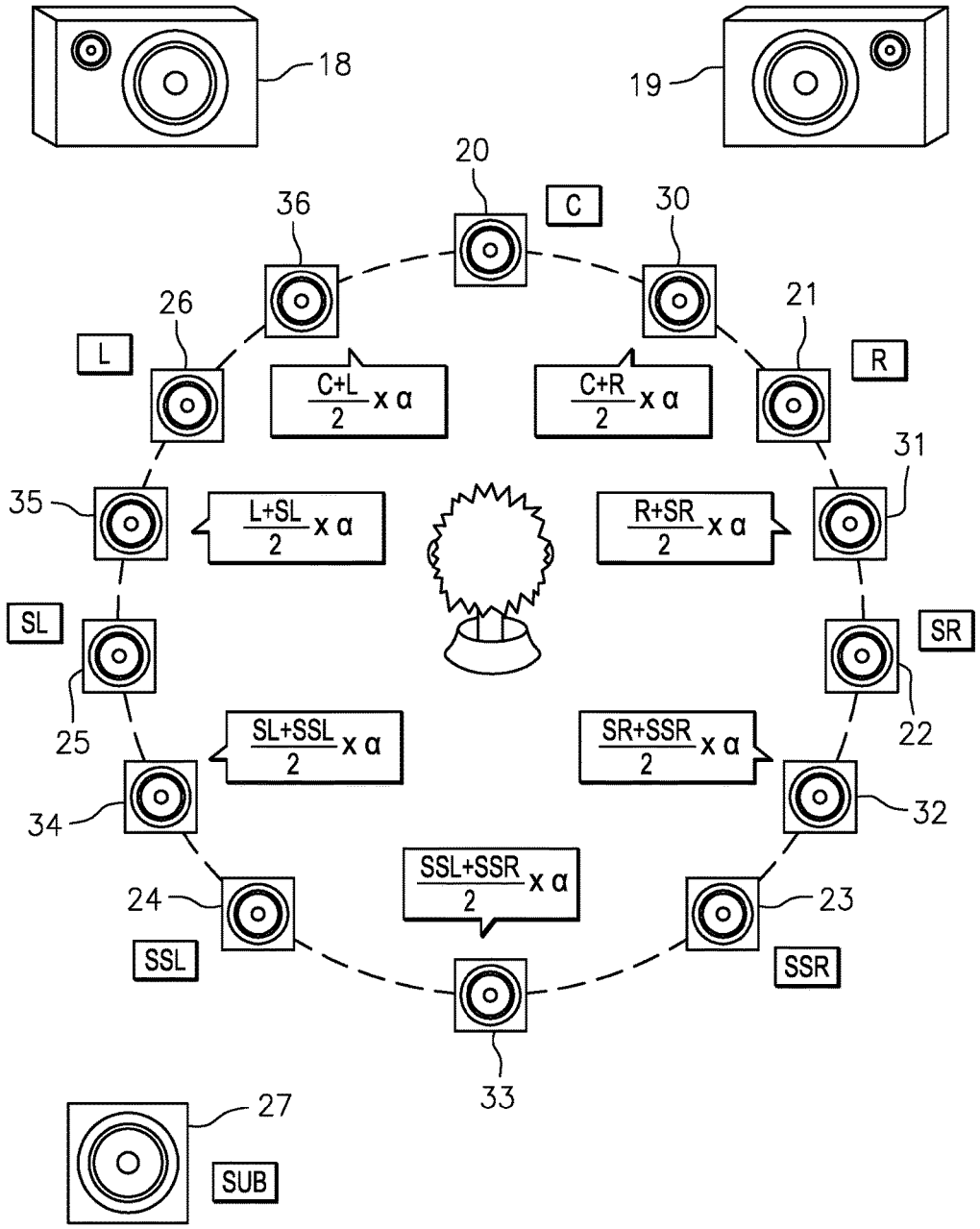
FIG. 3 shows a block diagram of the listening installation.

FIG. 3 shows a schematic view of the reproduction installation, from a pair of real loudspeakers 17, 18.

The loudspeakers 17, 18 receive a signal making it possible to simulate calculated loudspeakers 20 to 27 and 30 to 37.

The effective number of calculated loudspeakers 20 to 27 corresponds to the number of physical loudspeakers 5 to 11; 17 used for the production of the data base of pulse signals, or to the number of virtual loudspeakers reproduced according to the aforementioned method.

Besides, virtual loudspeakers 30 to 37 are created, thus producing a perception in the sound space of a combination of the neighbouring real loudspeakers, in order to fill the sound holes.

Such virtual loudspeakers are created by modifying the signal supplied to the neighbouring real loudspeakers.

Fifteen sound files are thus produced, 8 (7.1) corresponding to the processing from the pulse signals, and 7 ones being calculated by combining these fifteen files.

The signals are distributed according to their right, left or central component to produce a left signal 17 intended for the left loudspeaker, and a right signal intended for the right loudspeaker 18:

- the "right" signal corresponds to the addition of the calculated "right" signals 21, 22, 23 and the virtual "right" signals 30, 31, 32, as well as the calculated 20, 27 and virtual 33 "central" signals with a weighting on the order of 50%.
- the "left" signal corresponds to the addition of the calculated "left" signals 24, 25, 26 and the virtual "left" signals 34, 35, 36, as well as the calculated 20, 27 and virtual 33 "central" signals with a weighting of the order of 50%.

Such stereo signal is then applied to conventional audio equipment, connected to a pair of loudspeakers 18, 19 which will reproduce a spatialized soundscape corresponding to the soundscape of the installation which has been used for producing the data base of pulse signals, or a virtual soundscape corresponding to the combination of several original soundscapes, possibly enriched with virtual soundscapes.

The method according to the invention comprises a first step 1 in producing a database of at least one left-right impulse response (IR) pair; a second step 2 of transforming the stereo signal with one left-right IR pair selected in the abovementioned data base; a third step 3 of reproducing the transferred spatialized stereo signal.

First Step 1: Production of the Impulse Response (IR) Database

Each impulse response signal is realised by recording the signals produced by source loudspeakers in response to a reference multi-frequency signal in a certain physical space.

Figure 4:
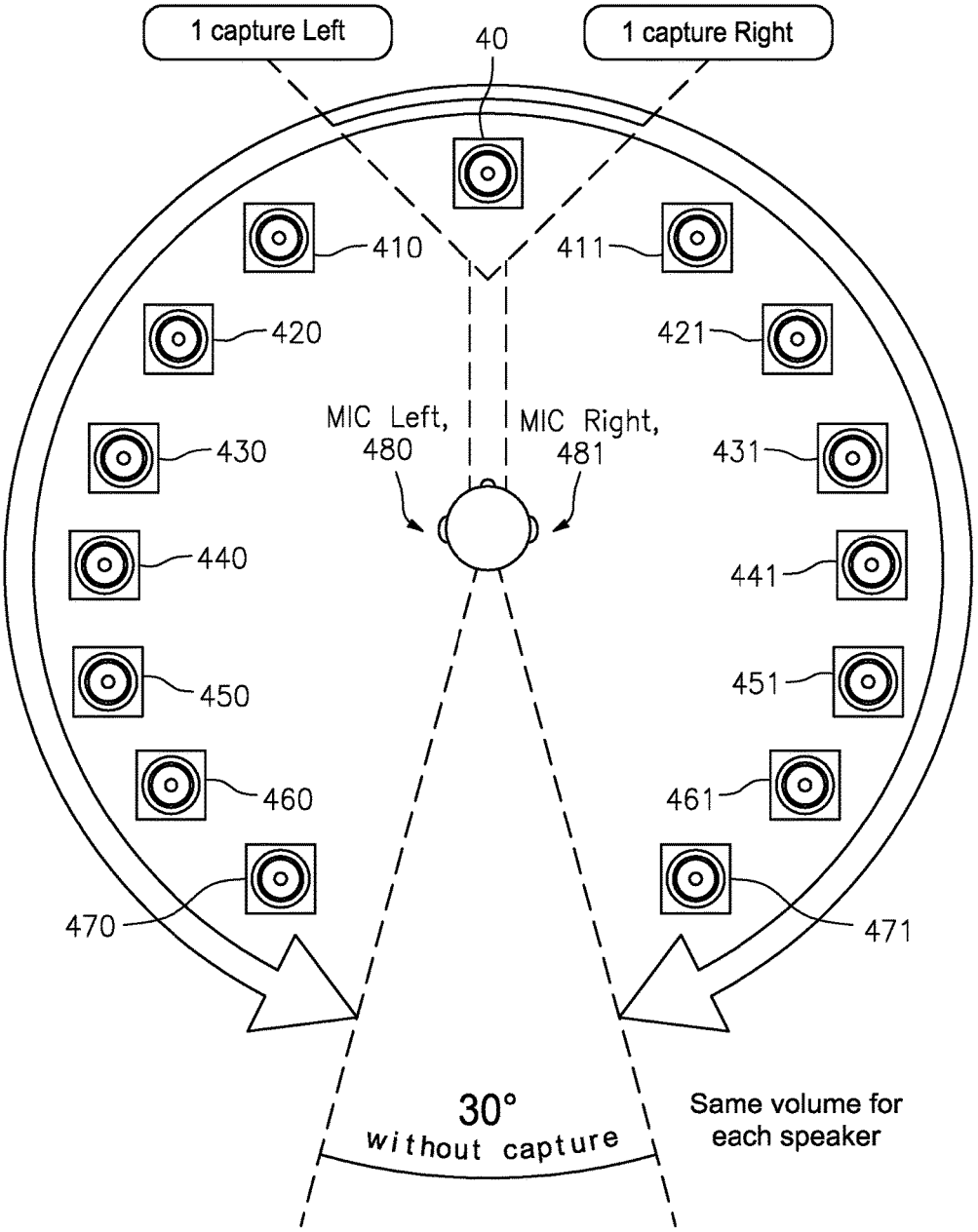
FIG. 4 shows the distribution of the sound source positions and the sound acquisition positions in a music mode.

FIG. 4 shows for example the acquisition of a music mode in a concert hall. In a music mode, all the source loudspeakers are at the same height.

A series of acoustic loudspeakers (410-471) is set as the sound sources at the sound source positions and a pair of acquisition microphones (480, 481) is set at sound acquisition positions indicated by the dummy head for the acquisition of sound.

The circle formed line with double arrows represents the distribution region of the sound source positions, which are around the sound acquisition positions situated at the left-right median plane of the circle. At the left hand-side of the median plane, are the left source loudspeakers 410, 420, 430, . . . 470, while the right source loudspeakers 411, 421, 431, . . . 471 are distributed at the right hand-side of the median plane. From front side to back side, each left source loudspeaker with a corresponding right source loudspeaker forms a pair. Each pair of loudspeakers 410-411, or 420-421 . . . 470-471 is distributed symmetrically relative to the acquisition position, that is to say, they are at the same distance from the left-right median plane, at the same front-back position and at the same height. In order to have a realistic sound effect, it is preferable to avoid any source loudspeaker at the region of 30° angle behind the sound acquisition positions. The production of a left-right IR pair can be realised without the central loudspeaker 40.

Then an original multi-frequency signal is applied at the same time to all the left loudspeakers with the same volume. Such original signal is for example a sequence having a duration ranging from 10 to 90 seconds, with a frequency variation within the sound spectrum, for example, a linear variation between 20 Hz and 20 kHz, or still any signal covering the whole spectrum of the loudspeaker.

The sound signal produced by the left loudspeakers is picked up by the couple of microphones 480 and 481 to generate a recorded stereo signal. Form this signal, a 96 kHz sampling is knowingly executed as well as a deconvolution by fast Fourier transform between the original stereo signal and the recorded stereo signal, to produce a left impulse response for the left source loudspeakers in the concert hall.

This step is reproduced for the right source loudspeakers to produce a right impulse response. In this way, a left-right IR pair is realized.

In another embodiment, it is preferable to get the left-right IR pair with the central loudspeaker 40, which is situated at the left-right median plane and exactly in front of the sound acquisition positions, and at the same height as the other sound source loudspeakers. The multi-frequency signal is applied at the same time to all the left loudspeakers plus the central loudspeaker with the same volume. The produced sound signal is picked up by the couple of microphones 480 and 481 and de-convoluted to produce a left impulse response. Then, the multi-frequency signal is applied at the same time to all the right loudspeakers plus the central loudspeaker with the same volume, the produced sound signal is picked up by the couple of microphones 480 and 481 and de-convoluted to produce a right impulse response. Such a left-right IR pair has the advantage that the central volume is doubled. Since most of the time, the displayer with the sound reproduction device is situated in front of a person, this left-right impulse response with doubled central volume gives a more realistic impression of the reproduction of the sound.

Then, the acquisition can be repeated in the same manner in different concert halls for producing different pairs of left-right IR. The above illustrated physical spaces, number of loudspeakers and multi-frequency signal are used only for example, but not have limitative effect. And different left-right pairs IR are realised from the acquisition of acoustic signals in different type of physical spaces.

Figure 5:
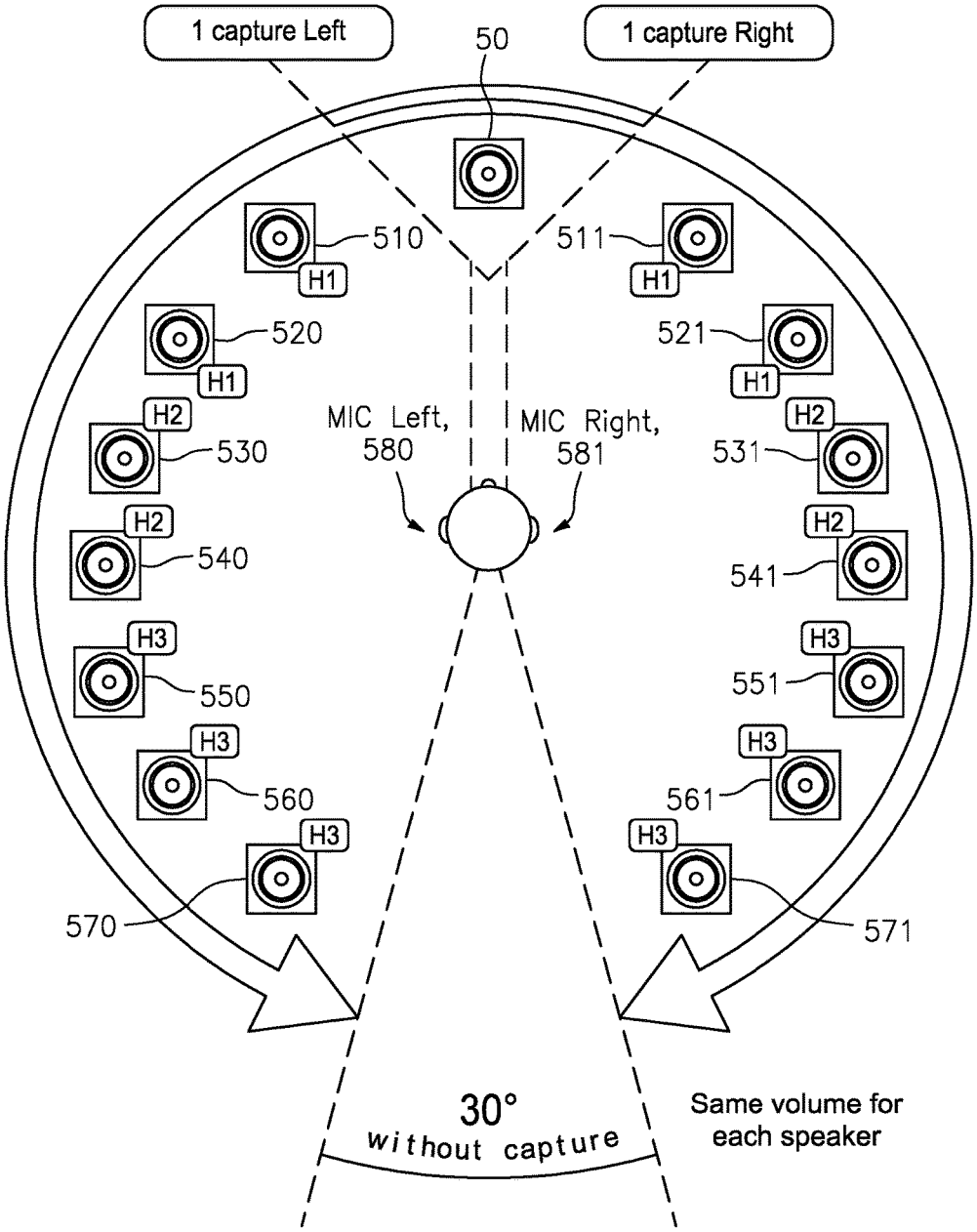
FIG. 5 shows the distribution of the sound source positions and the sound acquisition positions in a cinema mode.

FIG. 5 shows for example, the acquisition of a cinema mode, where the sound source positions are arranged at different heights. In a cinema mode, the sound source positions are distributed in a 4pi sphere around the sound acquisition position except a region corresponding to 30° solid angle behind the sound acquisition position. The FIG. 5 represents a top view, in which the circle formed line with double arrows represents the projection of the sound source positions on the horizontal plane of the sphere. A series of acoustic loudspeakers (510-571) is set as the sound sources at the sound source positions for the acquisition of sound. A pair of acquisition microphone (580, 581) is set at sound acquisition positions indicated by the dummy head.

The physical space shown in FIG. 5 can be divided into several different levels of heights, for example, the positions designated with H1 at 0.5 meters, with H2 at 1 meters, and with H3 at 1.5 meters. The numbers given above are for illustrative but not limitative purpose.

A left-right IR pair is realized by applying the multi-frequency signal and the deconvolution to the left and right source loudspeakers respectively as described for the music mode.

In another embodiment, it is preferable to get the left-right IR pair with the central loudspeaker 50, which is situated at the left-right median plane of the 4pi sphere and exactly in front of the sound acquisition positions. As for the height, it is usually set at the lowest position among all the source loudspeakers.

In a room with a home entertainment system, the TV is usually put at a height of 0.5 m, and our ears are located at a height of about 1 m at the sitting position. In a cinema room, the loudspeakers for the reproduction of the sound are arranged from lower to higher positions. Thus, the acquisition of a cinema mode is adapted to the sound reproduction configuration, with the sound source positions arranged in an increment pattern from the front side to the back side in the physical space.

Second Step 2 Preparation of a Spatialized Signal

Figure 6:
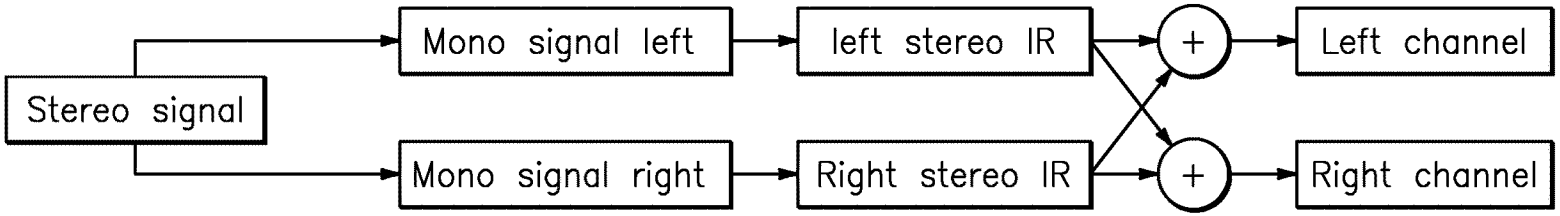
FIG. 6 shows a diagram of preparing a spatialized stereo signal.

As represented in FIG. 6, a stereo signal contains left and right two mono signals. For the "left mono signal/left stereo impulse response", a convolution processing is applied in order to calculate a left channel of a stereo spatialized signal. The same convolution process is carried out for the "right mono signal/right stereo impulse response" to produce a right channel of the stereo spatialized signal. Optionally, the left and right channels are equalized to improve the dynamics of signals.

Thus, the original stereo signal becomes spatialized. That is to say, a depth of the space is created for the stereo signal.

For the different series of left-right IR pairs acquired in different physical spaces, but with the same relative positions between the sound source positions and the acquisition positions, also acquired with the same volume, the different series of left-right IR pairs can be combined together to generate a virtual space. Thus, a stereo signal is spatialized with the sound effect of the virtual space.

The step 2 can be realised in different ways for different commercial models.

In the first model, the convolution process for the preparation of a spatialized stereo signal is realized at the remote server. The user only downloads the piece of music with a specified environment.

In the second model, the user himself realizes the convolution process for the preparation of spatialized signal locally. The stereo signal and the left-right IR pairs simulating different environments are provided separately. According to the personal preference of the environments, the user selects and changes the left-right IR pairs to process the stereo signal spatialization in his local processor.

Third Step 3 Reproduction of the Spatialized Stereo Signal

In general, any equipment with two transducers separated at a fixed distance can be used to reproduce the spatialized stereo signal, for example, a pair of real loudspeakers either on a tablet or on a smartphone. When the volumes in the two loudspeakers are equivalent, the audience has a perception that the reproduced sound situated in the middle. When the balance between the two loudspeakers changes, the sound moves accordingly. For example, when the volume of the left loudspeaker increases, the audience has the perception that the sound moves to the left hand side. Until the volume of the left loudspeaker is turned to the maximum, then the decrease of the volume of the right loudspeaker gives the audience the perception that the sound moves further to the left. When the right volume approaches zero, the sound approaches the extreme left. This is used to simulate, for example, in a movie, a car drives away from the audience and disappears at the far left hand side.

The reproduction of the spatialized stereo signal is also realized by a headphone with two channels at fixed positions relative to the audience ears. Since the sound acquisition is realized in a sphere, the headphone gives the audience the perception that at his left and right hand side, there is respectively a left and a right virtual loudspeaker, each with a hemi-sphere shape. With the change of the volume in each channel, the sound moves in the sphere around the audience. For example, when the volume of the left channel increases, and the volume of the right channel decreases, the audience has the perception that the sound moves from his front side, passing through his left hand side, to his back side. In addition, according to the acquisition mode, the sound can change its height in the space of the audience perception. With this technique, it is easy to simulate the sound effect of a helicopter approaching the audience from back side above his head. As explained above, the sound can walk in the whole space in the perception, by playing with the volume of each transducer.

Another application is for the replaying of a concert. It is possible to put different instruments at different positions, by adjusting the playing bars of each instrument, A tracking mode is also developed for the reproduction of the spatialized stereo signal. When the audience turns his head to put his attention at a certain object, his intention is captured by a sensor. By adjusting the ratio of volume between the left and right loudspeakers, or L/R channels of the headphone, the sound image is displaced in the position that the audience intends to discover. In this way, the sound image moves following the turning of the head of the audience to track the attention of the audience.

There has been provided a transaural synthesis method for sound spatialization. While the system and device has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A method of producing a spatialized stereo audio file from an original stereo audio file, comprising:

creating a data base of impulse responses, wherein creating said impulse response is realised in at least one physical space, said physical space is divided into left and right sides, front and back sides, up and down sides relative to a sound acquisition position, with at least one pair of acquisition microphones placed at the sound acquisition position, with at least two pairs of source loudspeakers placed at a plurality of sound source positions;

wherein said sound acquisition position is situated at the left-right median plane of said physical space, said sound source positions are distributed symmetrically by pairs relative to said sound acquisition position, said data base of impulse responses comprising at least one impulse response pair of a left impulse response and a right impulse response, the left impulse response being obtained by a deconvolution of a direct acquired signal from left source loudspeakers including all the source loudspeakers distributed at the left side of the physical space, wherein the direct acquired signal from the left source loudspeakers is based at least on a source signal applied at the same time to all the left source loudspeakers; and the right impulse response being obtained by a deconvolution of the direct acquired signal from right source loudspeakers including all the source loudspeakers distributed at the right side of the physical space, wherein the direct acquired signal from the right source loudspeakers is based at least on the source signal applied at the same time to all the right source loudspeakers.

2. The method according to claim 1, wherein a central loudspeaker is positioned at the sound source position situated at the left-right median plane and in front of the sound acquisition position, wherein the left impulse response is obtained by a deconvolution of the direct acquired signal from the left source loudspeakers and the central loudspeaker, wherein the right impulse response is obtained by a deconvolution of the direct acquired signal from the right source loudspeakers and the central loudspeaker.

3. The method according to claim 1, wherein said sound source positions are distributed around a circle of 360° around said sound acquisition position, except an arc region of 30° behind the sound acquisition position (music mode).

4. The method according to claim 3, wherein said sound source positions are distributed at the same height.

5. The method according to claim 1, wherein said sound source positions are distributed in a sphere of 4pi around said sound acquisition position, except a region corresponding to 30° solid angle behind the sound acquisition position (cinema mode).

6. The method according to claim 5, wherein each pair of sound source positions distributed symmetrically to the left-right median plan are at the same height, but not all pairs of sound source positions are at the same height.

7. The method according to claim 6, wherein from front side to the back side, the height of each pair of sound source positions increases.

8. The method according to claim 1, wherein the spatialized stereo audio file is realized by a treatment of convoluting the original stereo audio file with the said pair of left and right impulse response.

9. The method according to claim 8, wherein the treatment is realized remotely on a server.

10. The method according to claim 8, wherein the treatment is realized locally, on a local processor.

11. Utilization of the method according to claim 1, wherein during a broadcast of the spatialized stereo audio file, a reproduced virtual sound source position is movable by tuning the power balance between the left and right broadcast channels.

* * * * *